US010427855B2

(12) United States Patent
Barnitz et al.

(10) Patent No.: US 10,427,855 B2
(45) Date of Patent: Oct. 1, 2019

(54) INFLATABLE PACKAGING

(71) Applicants: Owen Townsend Barnitz, Saint Petersburg, FL (US); Kent Richey Colgate, Saint Petersburg, FL (US)

(72) Inventors: Owen Townsend Barnitz, Saint Petersburg, FL (US); Kent Richey Colgate, Saint Petersburg, FL (US)

(73) Assignees: Owen Townsend Barnitz, Saint Petersburg, FL (US); Kent Richey Colgate, Saint Petersburg, FL (US)

( * ) Notice: Subject to any disclaimer, the term of this patent is extended or adjusted under 35 U.S.C. 154(b) by 525 days.

(21) Appl. No.: 15/156,661

(22) Filed: May 17, 2016

(65) Prior Publication Data

US 2016/0340102 A1 Nov. 24, 2016

Related U.S. Application Data

(60) Provisional application No. 62/179,795, filed on May 19, 2015.

(51) Int. Cl.

| | |
|---|---|
| ***B65D 81/02*** | (2006.01) |
| ***B65D 81/05*** | (2006.01) |
| ***B65D 63/10*** | (2006.01) |

(52) U.S. Cl.

CPC ..... *B65D 81/052* (2013.01); *B65D 63/10* (2013.01); *B65D 81/054* (2013.01); *B65D 81/056* (2013.01)

(58) Field of Classification Search

CPC .... B65D 63/10; B65D 81/052; B65D 81/054; B65D 81/056

USPC ..... 206/522, 453, 586; 383/3

See application file for complete search history.

(56) References Cited

U.S. PATENT DOCUMENTS

| | | | | |
|---|---|---|---|---|
| 3,619,825 | A * | 11/1971 | Taub et al. | A47D 7/002 206/522 |
| 5,184,727 | A * | 2/1993 | Dickie | B65D 81/052 206/522 |
| 5,217,131 | A * | 6/1993 | Andrews | B65D 81/052 206/522 |
| 8,602,241 | B1 * | 12/2013 | Kuo | B65D 21/086 220/4.28 |
| 8,875,889 | B2 * | 11/2014 | Smith | B65D 81/052 206/521 |
| 2007/0022672 | A1 * | 2/2007 | Bachynski | E04H 9/14 52/90.1 |
| 2007/0039848 | A1 * | 2/2007 | Burchell | B65D 81/057 206/453 |

(Continued)

*Primary Examiner* — Luan K Bui

(74) *Attorney, Agent, or Firm* — Mattingly & Malur, PC

(57) ABSTRACT

Some examples include a plurality of inflatable units that may be secured to an item as packaging to protect the item during transport or other shipping. The inflatable units may be inflated to a threshold pressure and placed at the corners of the item to be transported. In some cases, prior to placement of the inflatable units at the corners of the item, beams may be placed between the inflatable units that will serve as the bottom inflatable units. Straps may be used to secure the inflatable units against the item, and the packaged item may be transported to a destination. Upon receipt of the shipped item, the recipient may remove the inflatable units from the corners of the item, deflate the inflatable units, and send the inflatable units and the straps back to the sender, who may reuse the inflatable units and the straps.

15 Claims, 9 Drawing Sheets

(56) References Cited

U.S. PATENT DOCUMENTS

| | | | | |
|---|---|---|---|---|
| 2007/0227935 | A1* | 10/2007 | Saito | B65D 81/057 206/586 |
| 2008/0053866 | A1* | 3/2008 | Cheng | B65D 81/053 206/592 |
| 2009/0250367 | A1* | 10/2009 | Murdoch | B65D 81/053 206/453 |
| 2011/0278199 | A1* | 11/2011 | Dane | A61L 2/26 206/586 |
| 2012/0031807 | A1* | 2/2012 | Shimomichi | B65D 81/057 206/586 |
| 2015/0090627 | A1* | 4/2015 | Yoshifusa | B65D 81/052 206/522 |

* cited by examiner

200

INFLATABLE PACKAGING

CROSS-REFERENCE TO RELATED APPLICATION

This application claims the benefit of U.S. Provisional Patent Application No. 62/179,795, filed May 19, 2015, the entire disclosure of which is incorporated herein by reference.

BACKGROUND

Large items are often shipped using custom-made crates, boxes, foam, and/or other types of non-reusable packaging. Such packaging is often discarded after the items are received by the recipient, and may end up in landfills or may require recycling. Not only does this result in a waste of manufactured materials, but it may also be detrimental to the environment. Furthermore, such non-reusable shipping options can be expensive for the shipper, and these expenses may be passed on to the recipients in the form of higher shipping prices and/or higher product prices overall.

SUMMARY

Some implementations herein include techniques and arrangements for reusable inflatable packaging in which at least a portion of the packaging may be returned for reuse. For example, the packaging apparatus may be inflated by a sender to be used for shipping or otherwise transporting an item. When transport of the item is completed, a portion of the packaging apparatus may be deflated to a smaller size so that the packaging apparatus can be more easily sent back to a location associated with the sender.

In some cases, the packaging apparatus may include a plurality of inflatable units that may be secured to an item as packaging to protect the item during transport of the item. The inflatable units may be inflated to a threshold pressure and placed at the corners of the item to be transported. The inflatable units may be secured to the item, and the packaged item may be transported to a destination. Upon receipt of the item, the recipient may deflate the inflatable units and send the inflatable units back to the sender, who may reuse the inflatable units for transporting another item.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Figure 1:
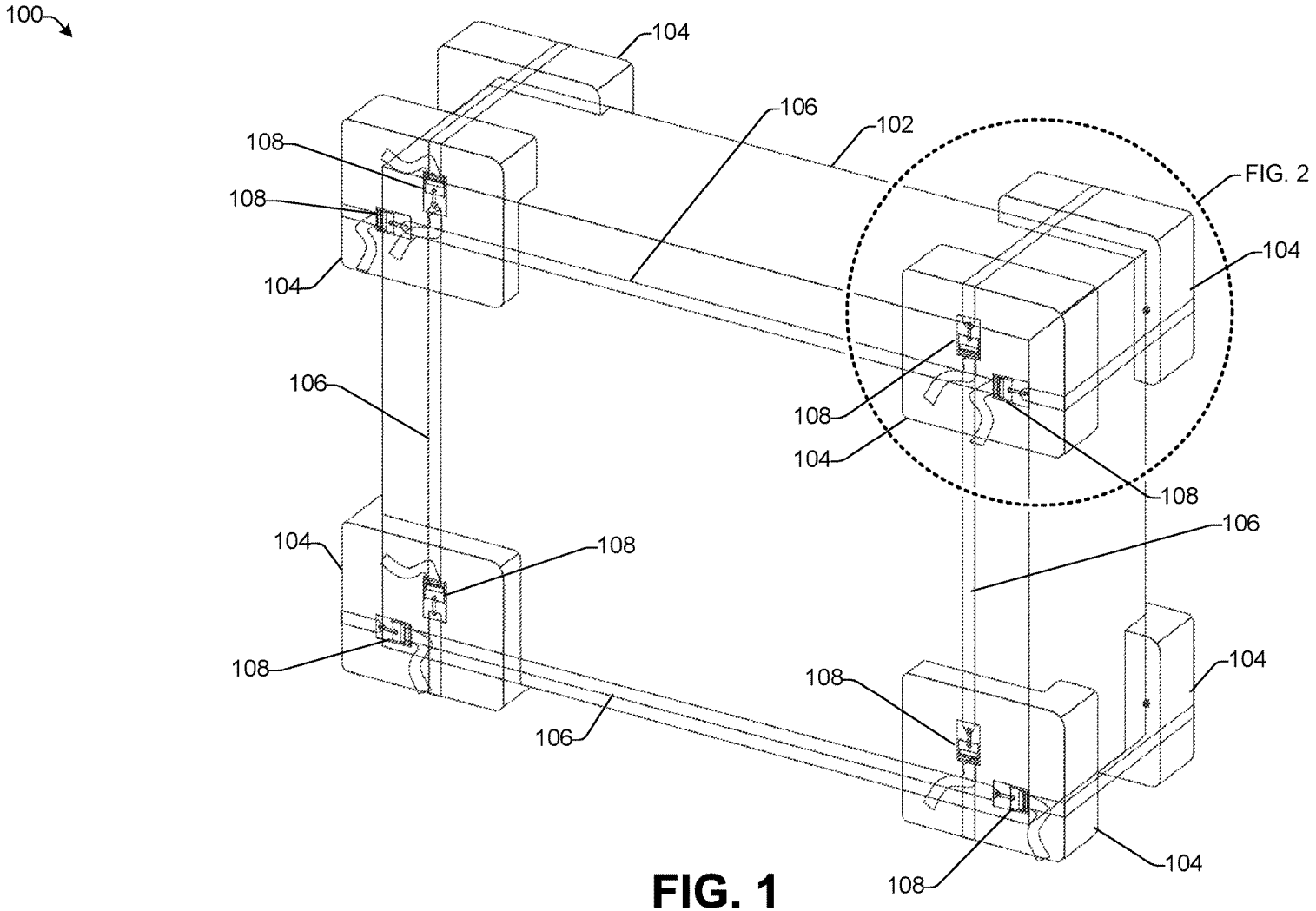
FIG. 1 illustrates an isometric view of an example packaging system according to some implementations.

Some examples herein are directed to reusable inflatable packaging in which at least a portion of the packaging may be returned for reuse. Thus, a packaging apparatus may be inflated to be used for shipping or otherwise transporting an item and, after use, may then be deflated to be returned to the sender. As one example, protective inflatable units may be placed at each of the corners of an item to be transported and a plurality of straps may be used to secure the inflatable units on the corners of the item.

In some examples, prior to placement of the inflatable units at the corners of the item, beams, such as slats, boards, or the like, may be placed between pairs of the inflatable units that will serve as the bottom supporting inflatable units. For example, the inflatable units may include recesses that receive the ends of the beams. Additionally, or alternatively, in some examples, a shielding layer may be placed over one or more surfaces of the item and retained in the recesses in the inflatable units.

The inflatable units may be secured to the item, and the item may then be transported to a destination, such as a shipping destination, or the like. When the transporting of the item is completed, the inflatable units may be removed from the item and may be deflated to a smaller size so that the inflatable units can be more easily sent back to the sender of the item. For instance, upon receipt of the transported item, the recipient may release the straps, remove the item from the inflatable units, or vice versa, deflate the inflatable units, and send the inflatable units and the straps back to the sender. The sender may then reuse the inflatable units and the straps for shipping another item. Alternatively, the recipient may reuse the inflatable units for shipping the same item or a different item.

The inflatable units may be generally identical and/or mirrored images to each other. For instance, a first group of the inflatable units may be generally the same and may be mirror images of a second group of the inflatable units. In other examples, as discussed with respect to FIG. 8, all the inflatable units may have the same configuration. Each inflatable unit may be constructed of one or more layers of a flexible polymer material, cloth, fiberglass, metal foil, and/or other suitable flexible material(s) that may be sufficiently strong to support the weight of the item to be transported, while being flexible enough to be deflated to a collapsed state for shipping back to the sender. Each inflatable unit may include a quick release valve stem that may be used to inflate the inflatable unit with air, and which may be opened to release the air from the inflatable unit when deflating the inflatable unit.

In some examples, the inflatable units may be maintained in contact with the corners of the item using a plurality of straps or other suitable attachment mechanism. For example, after the inflatable units have been placed on the respective corners of the item to be shipped, the straps may be tightened using strap tensioning devices. In some examples, the strap tensioning devices may be permanently attached to the inflatable units. In other examples, other types of strap tensioning devices may be used, such as turnbuckles or the like. In some cases, the straps may be returned to the shipper along with the inflatable units. Further, in some examples, the straps and/or the tensioning devices may be attached to the inflatable units.

For discussion purposes, some example implementations are described in the environment of shipping large hexahedral items. However, implementations herein are not limited to the particular examples provided, and may be extended to other types of items, other environments of use, other techniques for securing the inflatable units, and so forth, as will be apparent to those of skill in the art in light of the disclosure herein.

FIG. 1 illustrates an isometric view of an example packaging system 100 according to some implementations. For instance, an item 102 may be packaged for transport such as for shipping or other conveyance of the item to a destination. The packaging system 100 may include a plurality of reusable protective inflatable units 104 that may be placed at the corners of the item 102 to protect the item 102 during transportation of the item 102. The item 102 may be any type of item to be transported such as a box, a sign, an electronic component, a construction component, and so forth. Further, while several examples herein show the item 102 shaped as a hexahedron, box, cube, or the like, other examples are not limited to packaging items 102 of these shapes, and the examples herein may include items having other shapes and sizes, different packaging configurations, different number of corners, and the like.

Furthermore, the inflatable units 104 may be secured in place on the item 102 using various securing techniques. In the illustrated example, a plurality of straps 106 may be used to secure the inflatable units 104 to the corners of the item 102. For instance, a strap 106 may extend between at least two of the inflatable units 104 and, thus, in this example, four straps 106 may be used to secure a group of four of the inflatable units 104 by encircling a portion of the item 102 in a first direction, four more straps 106 may secure a different group of four inflatable units, and so forth. Strap tensioning devices 108 may be included with the straps 106 and/or may be attached to the inflatable units 104.

In addition, while eight inflatable units 104 are used in this example, in other examples more or fewer inflatable units 104 may be used for packaging an item 102. For instance, as one alternative, only four inflatable units 104 might be used on the bottom four corners of the item 102. As another alternative, the inflatable units 104 may be of a different shape and may extend along an entire side edge of an item 102 to cover multiple corners of the item with a single inflatable unit 104. As another example, the inflatable units 104 may be of a different shape and multiple inflatable units 104 may be placed at each corner of an item 102. Additionally, while in some examples the packaged item with inflatable units 104 may be transported in the configuration shown in FIG. 1, in other examples, the packaged item with inflatable units 104 secured thereto may be placed into a box, or the like, to provide additional protection to the item 102.

Figure 2:
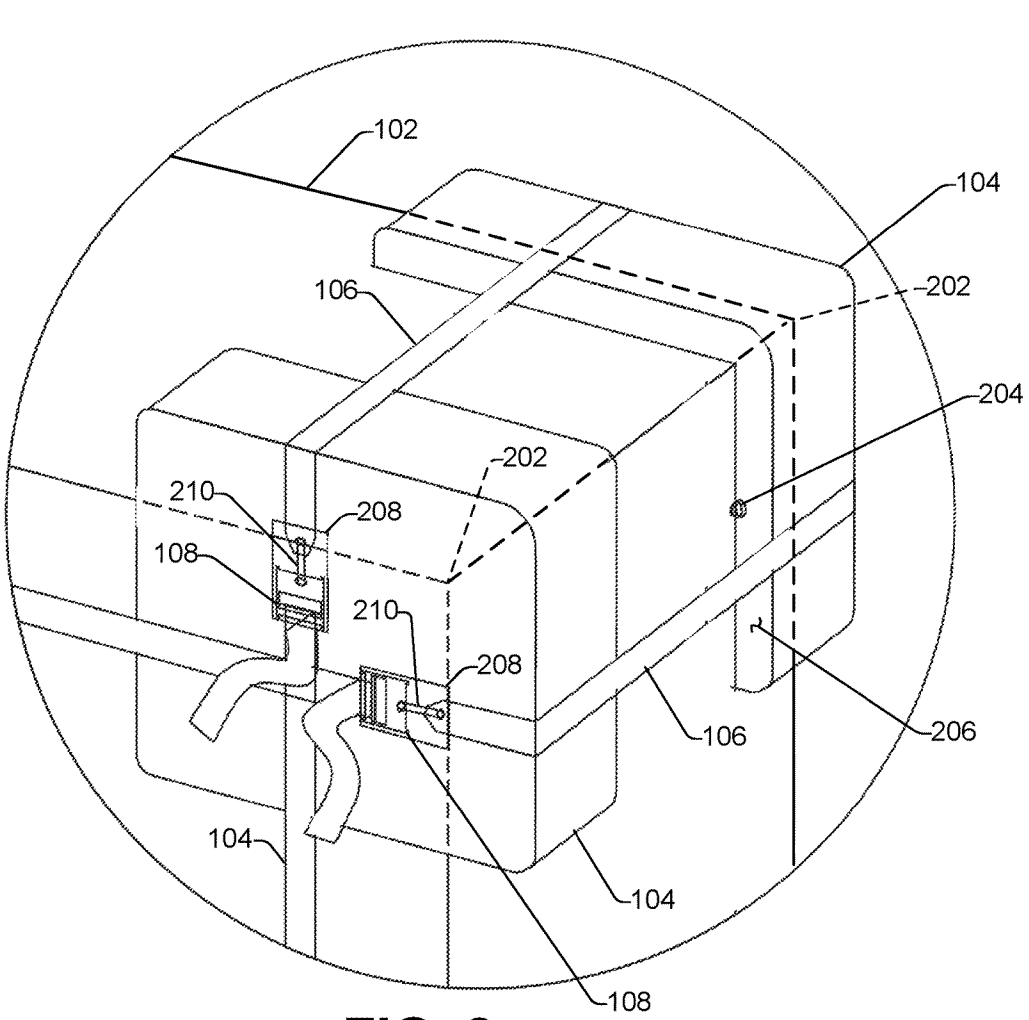
FIG. 2 illustrates an enlarged view of a portion of the packaging system of FIG. 1 according to some implementations.

FIG. 2 illustrates an enlarged view 200 of a portion of the packaging system of FIG. 1 according to some implementations. In this example, the inflatable units 104 are illustrated as being mounted on respective corners 202 of the item 102. Each inflatable unit 104 may include a valve 204, such as a quick release valve stem, or the like, that is mounted on a side surface 206 of the inflatable unit 104 so that the valve 204 is not located on an outer surface of the inflatable unit 104 that may typically be contacted during transport of the item 102. Accordingly, the valve 204 is accessible to inflate air into the inflatable unit 104 before, during, or after mounting of each inflatable unit 104 on a corner 202 of the item 102. Furthermore, the valve 204 may be manually opened to remove air for deflating the inflatable units 104, such as upon arrival of the packaged item 102 at a shipping destination.

In addition, in this example, the strap tensioning devices 108 are mounted to the inflatable units 104 at attachment areas 208 using any suitable attachment techniques such as adhesive, sewing, fastening, or the like. As one example, the strap tensioning devices 108 may be metal or polymer tie-down brackets, which may include spring hooks 210 for connecting the strap ends to the tensioning devices 108. Furthermore, while one example of a strap tensioning device 108 is illustrated in the examples herein, numerous other types of strap tensioning devices will be apparent to those of skill in the art having the benefit of the disclosure herein.

Figure 3A:
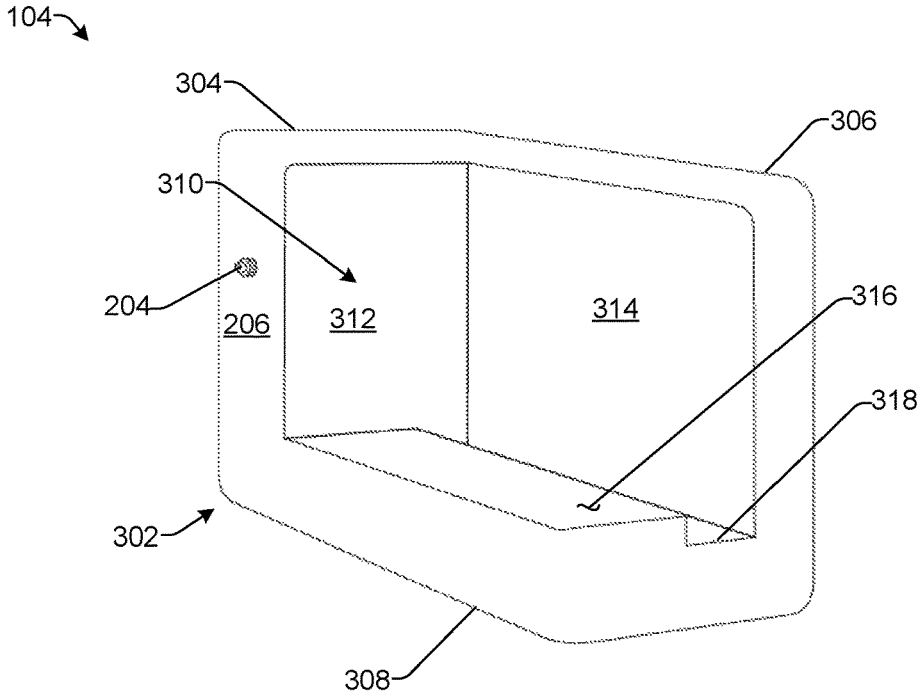
FIGS. 3A and 3B illustrate isometric views of an example inflatable unit according to some implementations.

FIG. 3A illustrates an isometric view of an example inflatable unit 104 according to some implementations. The inflatable unit 104 may include an inflatable body 302 having three walls 304, 306, and 308 connected at generally right angles to each other to form a corner receiving space 310. For instance, the corner receiving space 310 may be configured to receive a corner of an item (not shown in FIG. 3A). Each of the three walls 304, 306, and 308 may include an inner surface for contacting the item when the inflatable unit 104 is secured to the item. Accordingly, a first wall 304 includes a first inner surface 312 and a second wall 306 includes a second inner surface 314. The inner surface of the third wall 308 may include an item contact surface 316 and a recess 318. In some examples, the item contact surface 316 may be configured as a shelf to contact the item. The recess 318 may be configured to receive a beam, or the like, which may extend between two of the inflatable units 104, as discussed additionally below. Furthermore, in this example, the valve 204 is shown on the side surface 206 of the first wall 304. However, in other examples, the valve 204 may be on any suitable side surface of any of the walls 304, 306, or 308, so as to be accessible while the item is in the item receiving space 310, but not on the outer surfaces of the walls 304 306 or 308, where the valve 204 might be damaged or accidentally opened.

Figure 3B:
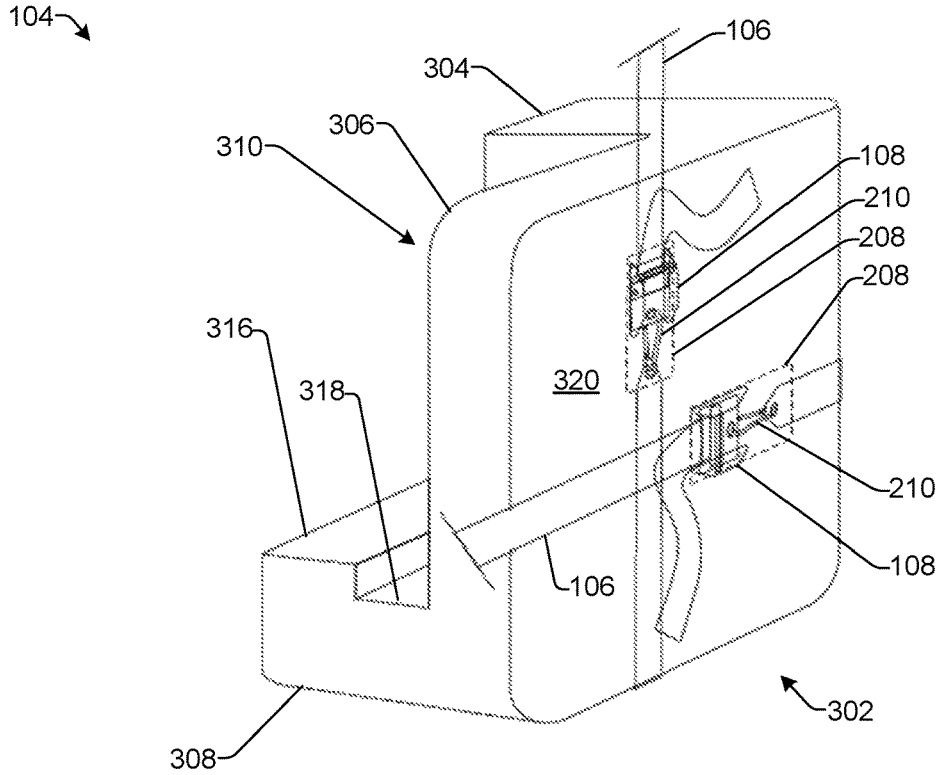

FIG. 3B illustrates an isometric view of the example inflatable unit 104 of FIG. 3, rotated to the left according to some implementations. In this example, the strap tensioning devices 108 are positioned on an outer surface 320 of the second wall 306. In other examples, one or more of the strap tensioning devices 108 may be positioned on an outer surface of the first wall 304 (not visible in FIG. 3B). Furthermore, while a first group of the inflatable units 104 used for packaging an item may have the configuration shown in FIGS. 3A and 3B, a second group of the inflatable units 104 may have a mirror image configuration of the inflatable unit 104 illustrated in FIGS. 3A and 3B so as to conform to opposite corners of the item.

Figure 4A:
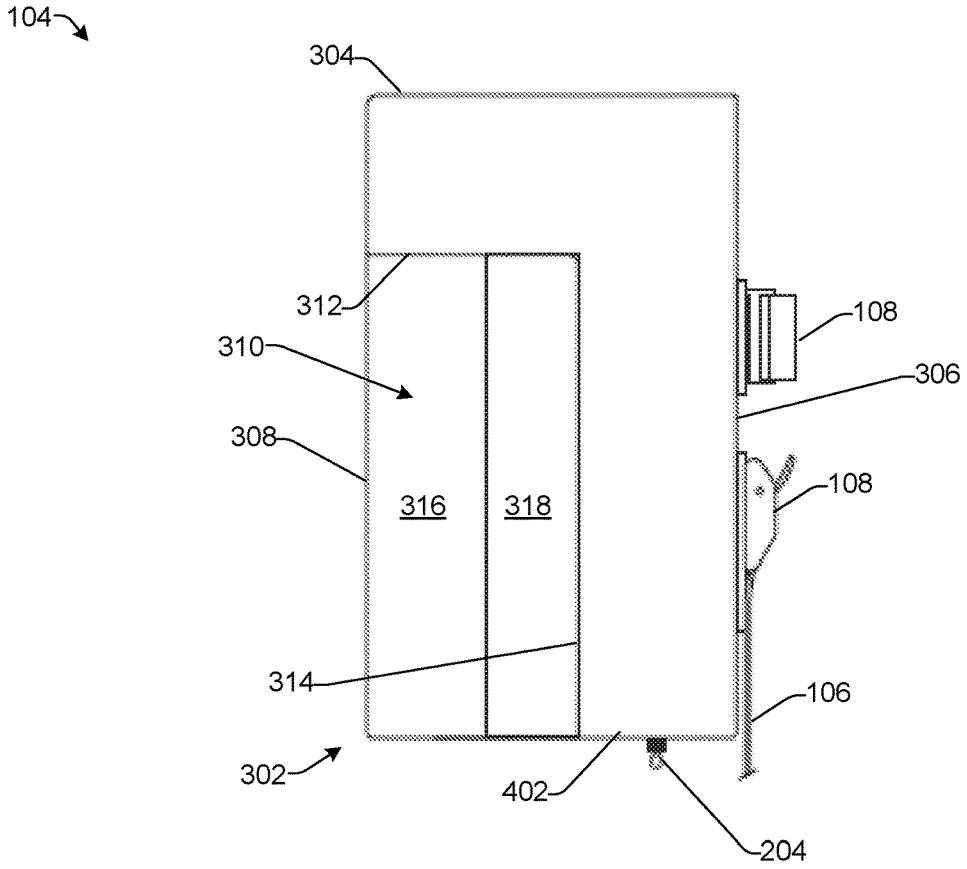
FIGS. 4A and 4B illustrate top and end views, respectively, of an example inflatable unit according to some implementations.
Figure 4B:
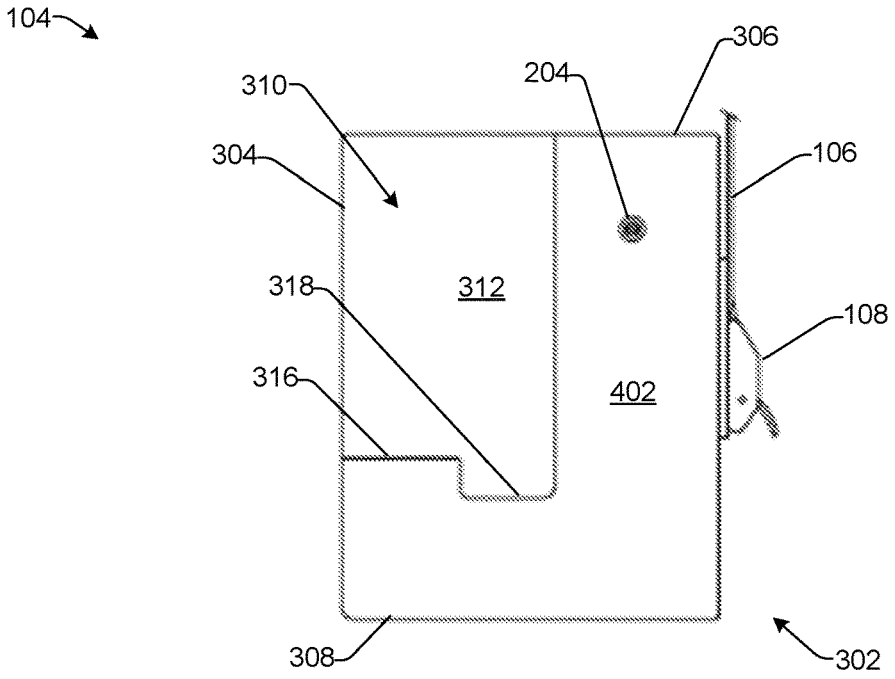

FIGS. 4A and 4B illustrate top and end views, respectively, of the example inflatable unit 104 according to some implementations. In this example, the inflatable unit 104 of FIGS. 4A and 4B has the valve 204 located on a side surface 402 of the second wall 306, rather than on the side surface 206 illustrated in FIGS. 2, 3A, and 3B. In the illustrated example, the recess 318 extends all the way to the inner surface 312; however, in other examples, the recess 318 might extend only a portion of the way to the inner surface 312. Additionally, as mentioned above, a first number of the inflatable units 104 used for packaging an item may have the configuration shown in FIGS. 4A and 4B, and the other half of the inflatable units 104 may be a mirror image of the inflatable unit 104 illustrated in FIGS. 4A and 4B so as to conform to opposite corners of the item. Alternatively, in other examples, as discussed below with respect to FIG. 8, the inflatable units 104 may all have the same configuration, and a second recess shown in FIGS. 4A and 4B) may intersect the recess 318.

Figure 5:
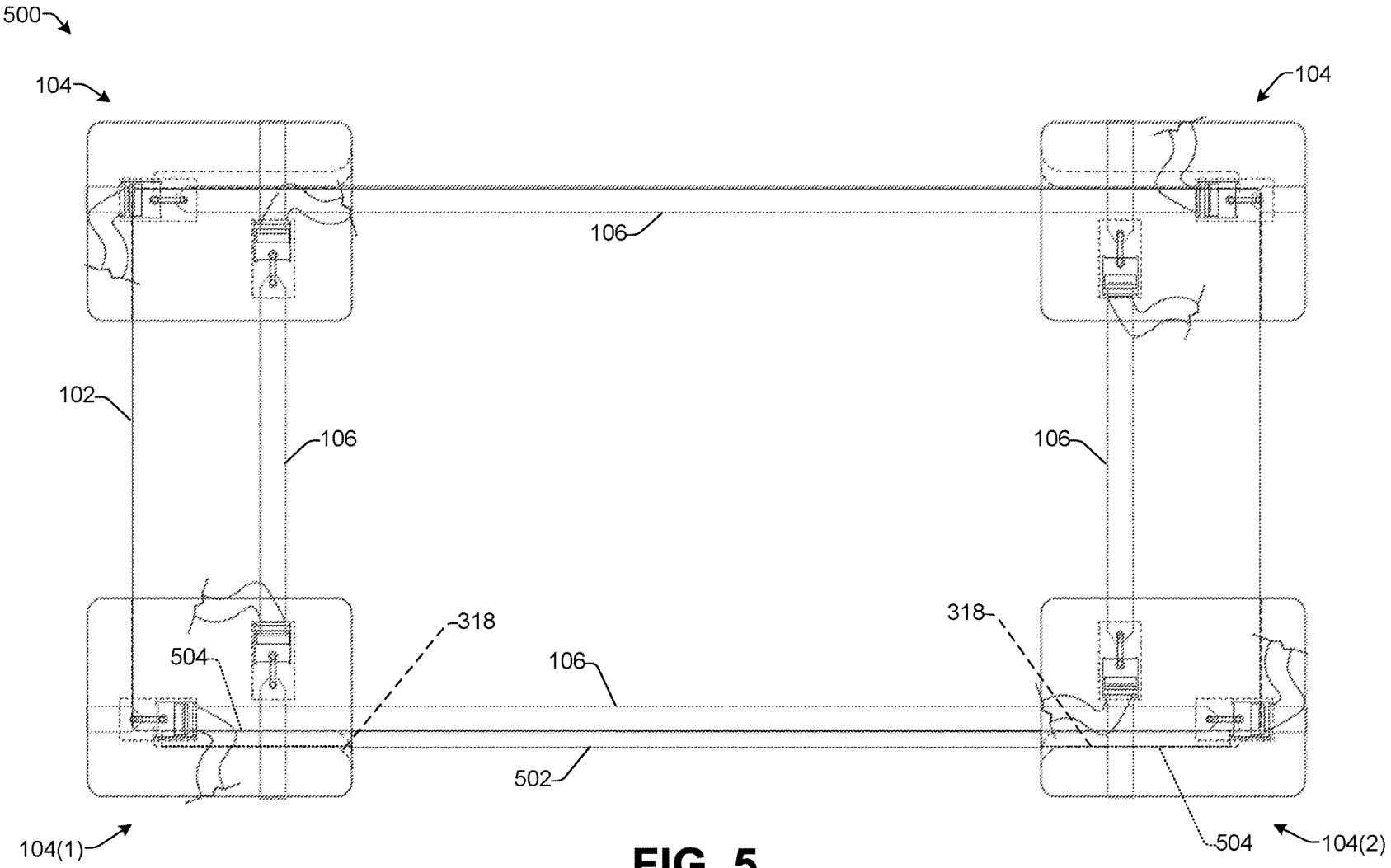
FIG. 5 illustrates an example elevation view of the packaging system, with one or more beams placed in the bottom inflatable units according to some implementations.

FIG. 5 illustrates an example side elevation view of a packaging system 500 with one or more beams 502 placed in the bottom inflatable units 104 according to some implementations. For instance, as mentioned above, the inflatable units 104 may be configured with the recesses 318. Ends 504 of the beam 502 may be placed into the recesses 318 of opposed inflatable units 104. For instance, the beam 502 may be placed into the recesses 318, such as prior to placement of the item 102 onto bottom inflatable units 104(1) and 104(2). As one example, the beam 502 may serve to support the weight of the item 102 and/or protect the bottom of the item 102, such as when lifting the packaged item 102 with a forklift or the like. The beam 502 may be any suitable material including wood, fiberglass or other polymer, metal, or the like. As one non-limiting example, 2×4 boards may be used as the beams 502.

Figure 6:
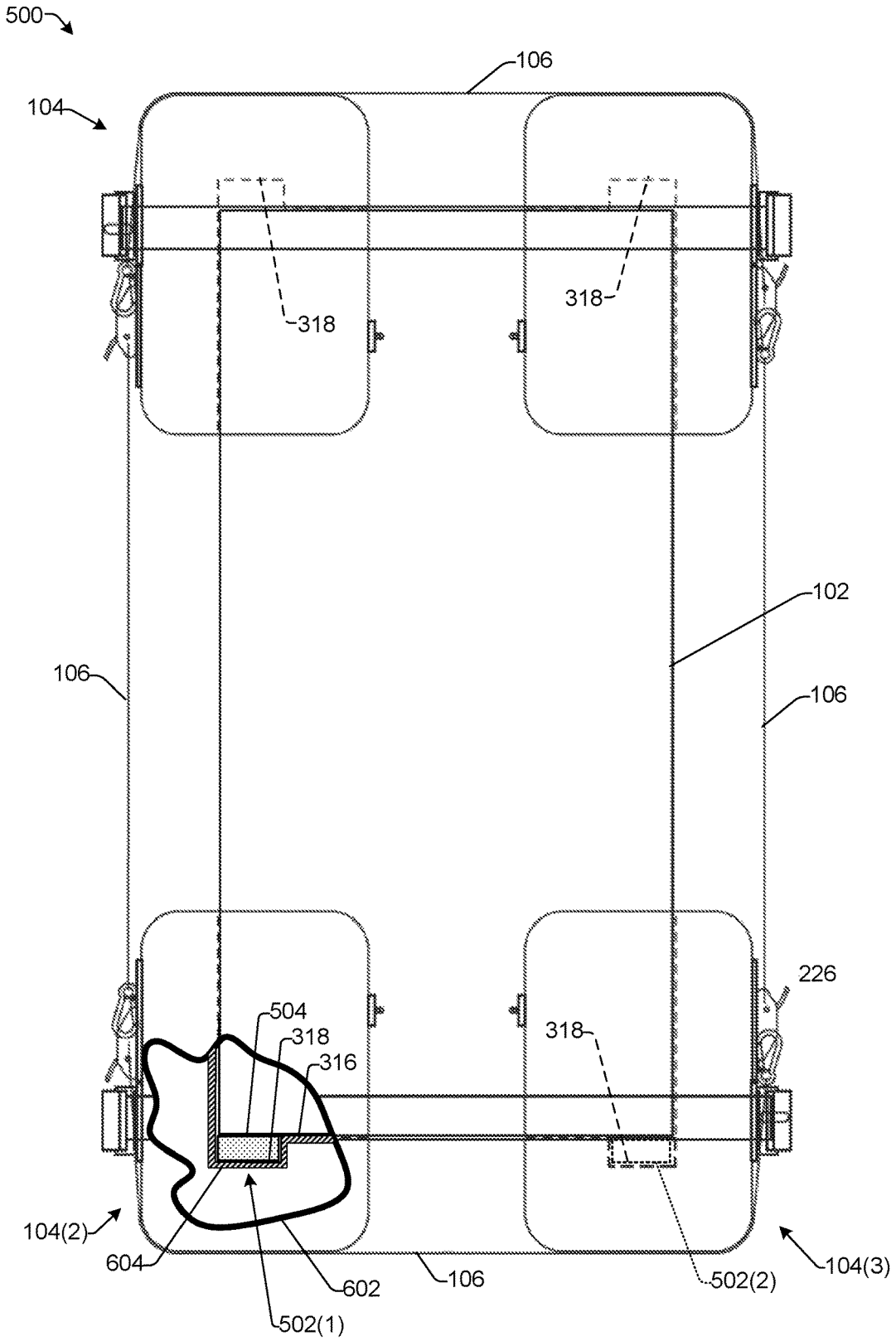
FIG. 6 illustrates an example end elevation view, showing beam placement according to some implementations.

FIG. 6 illustrates an example right end elevation view of the example packaging system 500 of FIG. 5, including two beams 502 according to some implementations. In this example, at 602, a portion of the bottom inflatable unit 104(2) is shown cutaway to provide a view of a wall 604 of the inflatable unit 104(2), the recess 318 and the item contact surface 316. The beam end 504 of the beam 502 is shown in the recess 318. In some examples, the length of the beam 502 may approximately match the length of the item 102 so that the beam end 504 extends approximately the length of the recess 318. As illustrated in FIG. 5, the first beam 502 may extend into the recess of the opposing bottom inflatable unit 104(1) (not shown in FIG. 6). In the example of FIG. 6, a second beam 502(2) is shown in the recess 318 of a third bottom inflatable unit 104(3). For example, this second beam 502 may extend to a recess in an opposing bottom inflatable unit not shown in FIG. 6. Accordingly, when the beams are installed in the recesses 318 and the inflatable units are secured to the item 102, the beams 502 may not be able to be removed until the inflatable units 104 have been removed from the item 102.

Figure 7:
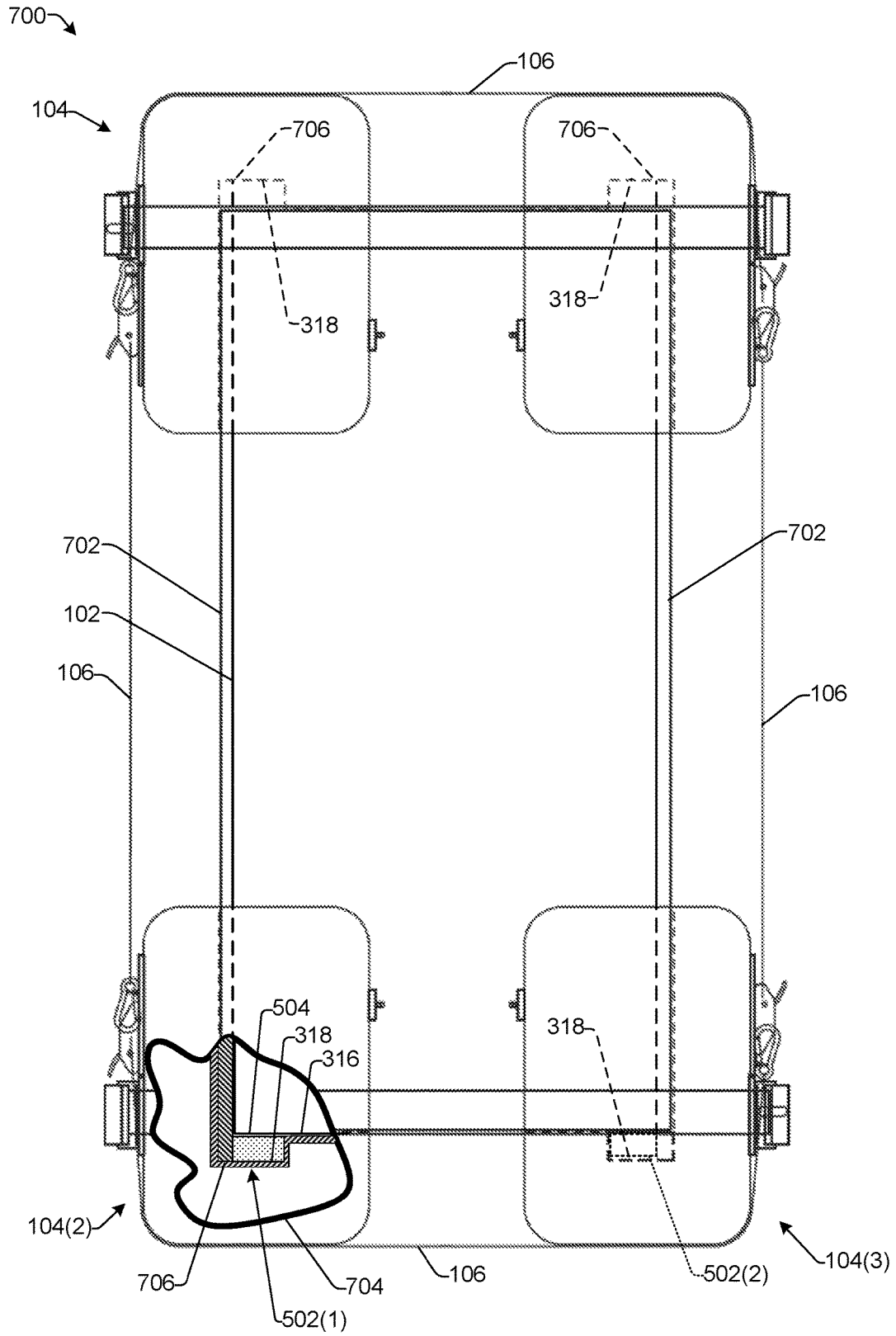
FIG. 7 illustrates an example end elevation view showing beam and shielding layer placement according to some implementations.

FIG. 7 illustrates an example end elevation view of a packaging system 700 including one or more shielding layers 702 according to some implementations. For example, a first planar shielding layer 702 may be placed on a first side of the item 102 and a second planar shielding layer 702 may be placed on a second side of the item 102. As illustrated in cutaway 704 of the inflatable unit 104, a portion 706 of the inflatable shielding layer 702 may be received into the recess 318 of the inflatable unit 104(2). In some cases, the shielding layer 702 may extend entirely across the side of the item 102, such that a portion 706 of the shielding layer 702 is received in each of the recesses 318 of the inflatable units 104 on one side of the item 102 for protecting the side of the item 102. Furthermore, the shielding layer 702 may be used with or without the beams 502. In the illustrated example, a first shielding layer 702(1) is shown adjacent to the first beam 502(1) and a second shielding layer 702(2) is shown adjacent to the second beam 502(2).

In some examples, the shielding layer 702 may be constructed of cardboard or other suitable material that may be formed into a box. Following transport of the item 102 to a destination, the shielding layer 702 may be removed, formed into the box, and the inflatable items 104 may be deflated and placed into the box. For example, the box may include a preprinted shipping label and/or prepaid postage to enable the recipient to send the inflatable items 100 for back to the sender.

Figure 8A:
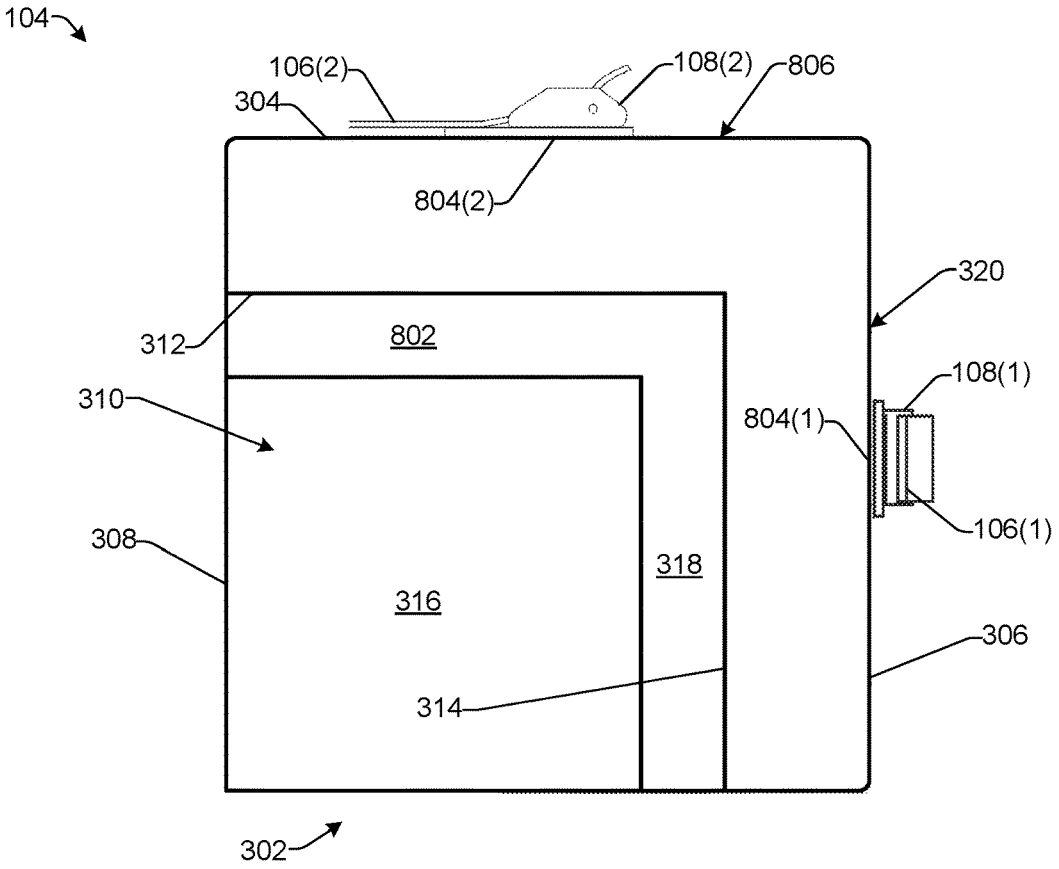
FIGS. 8A and 8B illustrates top and end views, respectively, of an example inflatable unit according to some implementations.
Figure 8B:
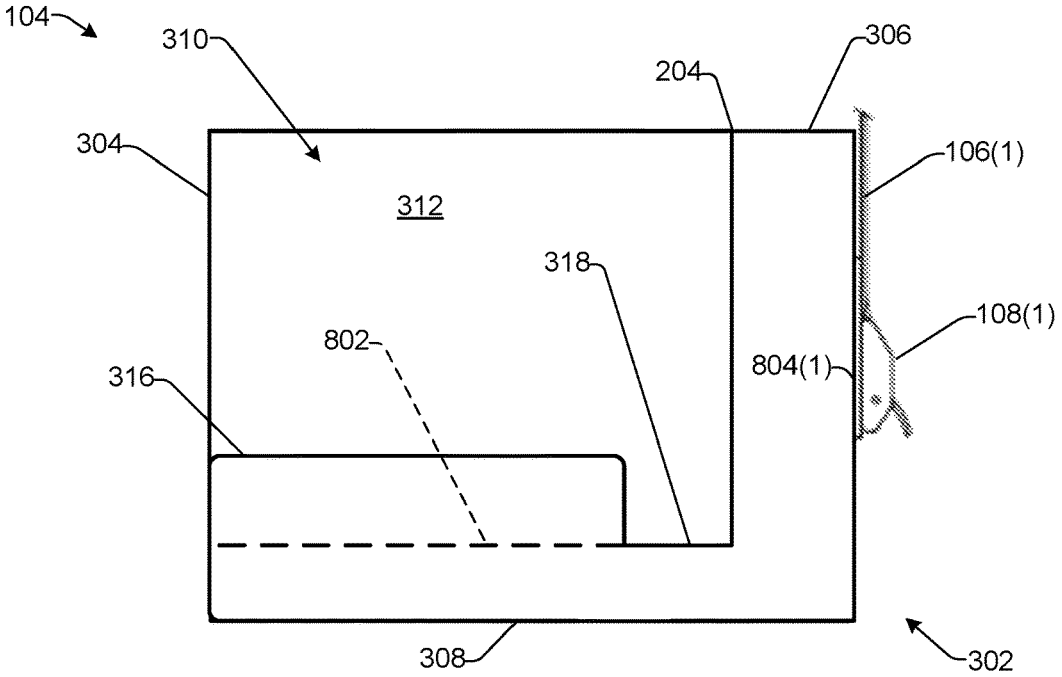

FIGS. 8A and 8B illustrate top and end views, respectively, of an example inflatable unit according to some implementations. In this example, the inflatable unit 104 includes a second recess 802 generally perpendicular to the recess 318 and adjacent to the inner surface 312. Accordingly, in this example, the inflatable units 104 may be all generally identical in configuration and mirror image versions are not used. Consequently, when a user places the inflatable unit 104 onto the item, the user does not have to be concerned with the orientation of the inflatable unit 104.

Furthermore, in this example, a first one of the strap tensioning devices 108(1) may be mounted on the outer surface 320 of the wall 306 by a first swivel mechanism 804(1) that enables the first strap tensioning device 108(1) to pivot or otherwise swivel at least 90 degrees. Thus, the first strap tensioning device 108(1) may be swiveled between having the corresponding strap 106(1) facing a first direction (shown) and a second direction (not shown). Further, in some examples, the swivel mechanism 804 may allow the strap tensioning device 108 to swivel 180 degrees and/or 360 degrees. A second strap tensioning device 108(2) may be mounted on an outer surface 806 of the wall 304 with a second swivel mechanism 804(2), which enables a corresponding second strap 106(2) to be oriented between at least two directions that differ by approximately 90 degrees or more. Accordingly, when mounted on a corner of an item to be transported (not shown in FIGS. 8A and 8B), the first strap tensioning device 108(1) may be positioned to secure the inflatable unit 104 to the item by applying tension in a first direction or first orientation, and the second strap tensioning device 108(2) may be positioned to secure the inflatable unit 104 to the item by applying tension in a second direction or second orientation.

Figure 9:
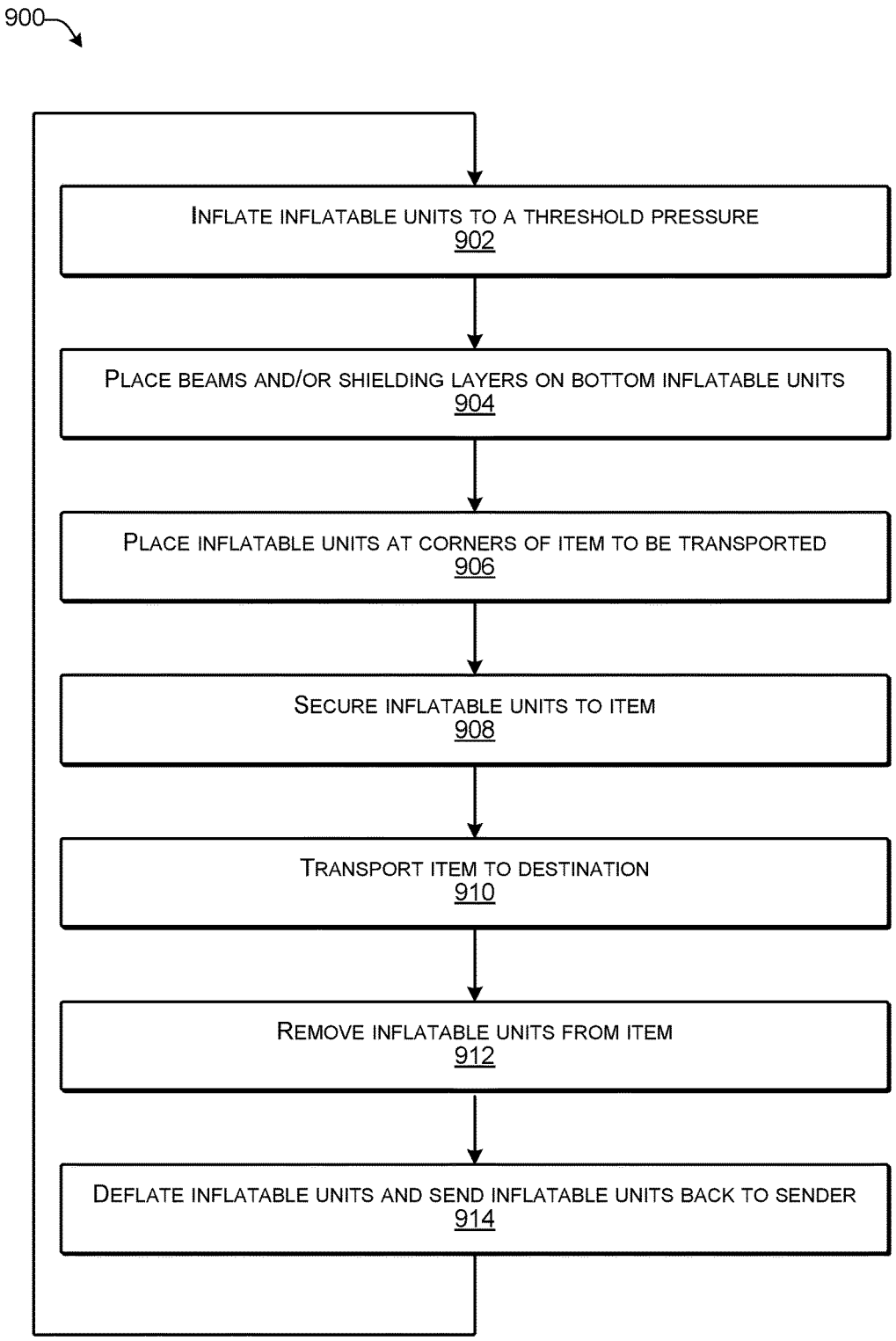
FIG. 9 is a flow diagram illustrating an example process according to some implementations.

FIG. 9 is a flow diagram illustrating an example process according to some implementations. The process is illustrated as a collection of blocks in a logical flow diagram, which represents a sequence of operations. The order in which the blocks are described should not be construed as a limitation. Any number of the described blocks can be combined in any order and/or in parallel to implement the process, or alternative processes, and not all of the blocks need be executed. For discussion purposes, the process is described with reference to the apparatus and arrangements described in the examples herein, although the process may be implemented with a wide variety of other apparatuses and arrangements.

FIG. 9 is a flow diagram illustrating an example process 900 for packaging and transporting an item using the inflatable units herein according to some implementations.

At 902, the inflatable units are inflated to a threshold pressure. For example, the inflatable units may be inflated to a threshold pressure sufficient to support the weight of an item to be shipped without collapse or substantial deformation.

At 904, in some examples, prior to placement of the inflatable units at the corners of the item, beams, such as slats, may be placed between two pairs of the inflatable units that will serve as the bottom supporting inflatable units. For example, a first end of a first beam may be placed in a beam-receiving recess in a first inflatable unit and a second end of the first beam may be placed in a beam-receiving recess in a second inflatable unit. Further a first end of a second beam may be placed in a beam-receiving recess in a third inflatable unit and a second end of the second beam may be placed in a beam-receiving recess in a fourth inflatable unit. Additionally, or alternatively, one or more shield layers may be placed in the beam-receiving recesses and may extend between two or more of the inflatable units alongside or on top of the beams. Still alternatively, in some cases, the one or more shield layers may be used instead of the one or more beams. Further, in other examples, such as in the case that the item is not fragile, the beams and/or shield layers might not be used. In some examples, the shield layer may be cardboard or other suitable material that may be configured to be folded into a box that may be used for shipping the inflatable units and back to the sender.

At 906, the inflatable units are placed at the corners of the item. For example, if the item is a hexahedron, such as a cube, cuboid, box, or the like, having eight corners, then an inflatable unit may be placed at each of the eight corners.

At 908, the inflatable units may be secured to the item. For example, straps may be used to secure the inflatable units against the item corners. In some cases, the straps may connect or encompass at least two inflatable units, and a plurality of straps may be used to apply a restraining force to the inflatable units so that the inflatable units are maintained in position on the corners of the item. In some examples, additional air may be inflated into the inflatable units following tightening of the straps to further secure the inflatable units to the item.

At 910, the item is transported to a destination, such as a shipping destination. For example, the item may be protected during transport by the packaging apparatus including the inflatable units, as well as the beams and shielding layers, if any.

At 912, upon receipt of the shipped item, the recipient may remove or loosen the straps and remove the inflatable units from the corners of the item.

At 914, the recipient may deflate the inflatable units and send the inflatable units and the straps back to the sender, who may reuse the inflatable units and the straps. In some examples, the case that a shielding layer is included, the shielding layer may be configured to be folded into a box, which may have a preprinted shipping label and/or prepaid postage thereon. The inflatable units may be deflated, placed into the box, and sent back to the sender.

The example processes described herein are only examples of processes provided for discussion purposes. Numerous other variations will be apparent to those of skill in the art in light of the disclosure herein.

Although the subject matter has been described in language specific to structural features and/or methodological acts, it is to be understood that the subject matter defined in the appended claims is not necessarily limited to the specific features or acts described. Rather, the specific features and acts are disclosed as example forms of implementing the claims.

What is claimed is:

1. A system for packaging an item, the system comprising:

a plurality of inflatable units, wherein a respective inflatable unit is located at a respective corner of a plurality of corners of the item;

a plurality of straps securing the inflatable units to the corners of the item; and a beam extending between two of the inflatable units that support the item, such that a first end of the beam is located in a recess of a first one of the inflatable units and a second end of the beam is located in a recess of a second one of the inflatable units.

2. The system as recited in claim 1, wherein individual ones of the straps extend between at least two inflatable units of the plurality of inflatable units.

3. The system as recited in claim 1, wherein each inflatable unit comprises a body having three inflatable walls positioned substantially at right angles with respect to each other to form a corner-receiving area able to receive a corner of the item.

4. The system as recited in claim 3, wherein at least some of the inflatable units comprise:

one of the walls includes the recess able to receive at least one of the beam or a shielding layer; and an item support shelf adjacent to the recess for contacting the item when the corner of the item is positioned in the corner receiving area.

5. The system as recited in claim 1, further comprising a shielding layer extending between two of the inflatable units, such that a first edge of the shielding layer is located in the recess of the first one of the inflatable units and a second edge of the shielding layer is located in the recess of the second one of the inflatable units.

6. The system as recited in claim 1, further comprising at least one strap tensioning device attached to an outer surface of individual ones of the inflatable units.

7. The system as recited in claim 1, wherein there are eight of the inflatable units positioned at eight corners of the item, respectively, and there are two beams extending between two pairs of the inflatable units, respectively, along a same side of the item.

8. The system as recited in claim 1, wherein an individual inflatable unit of the plurality of inflatable units includes:

a body having three inflatable walls positioned substantially at right angles with respect to each other to form a corner-receiving area able to receive a corner of the item;

wherein the recess is a first recess located between a first wall and a second wall of the three inflatable walls, and able to receive the beam as a first beam; and wherein a second recess is located between the first wall and a third wall of the three inflatable walls, and able to receive a second beam, wherein the second recess is substantially perpendicular to the first recess.

9. A system for packaging an item, the system comprising:

a plurality of inflatable units, wherein a respective inflatable unit is located at a respective corner of a plurality of corners of the item;

a plurality of straps securing the inflatable units to the corners of the item; and a shielding layer extending between two of the inflatable units, such that a first edge of the shielding layer is located in a recess of a first one of the inflatable units and a second edge of the shielding layer is located in a recess of a second one of the inflatable units.

10. The system as recited in claim 9, wherein individual ones of the straps extend between at least two inflatable units of the plurality of inflatable units.

11. The system as recited in claim 9, wherein each inflatable unit comprises a body having three inflatable walls positioned substantially at right angles with respect to each other to form a corner-receiving area able to receive a corner of the item.

12. The system as recited in claim 11, wherein at least some of the inflatable units comprise:

one of the walls includes the recess able to receive at least one of a beam or the shielding layer; and an item support shelf adjacent to the recess for contacting the item when the corner of the item is positioned in the corner receiving area.

13. The system as recited in claim 9, further comprising a beam extending between two of the inflatable units that support the item, such that a first end of the beam is located in the recess of the first one of the inflatable units and a second end of the beam is located in the recess of the second one of the inflatable units.

14. The system as recited in claim 13, wherein there are eight of the inflatable units positioned at eight corners of the item, respectively, and there are two beams extending between two pairs of the inflatable units, respectively, along a same side of the item.

15. The system as recited in claim 9, wherein an individual inflatable unit of the plurality of inflatable units includes:

a body having three inflatable walls positioned substantially at right angles with respect to each other to form a corner-receiving area able to receive a corner of the item;

wherein the recess is a first recess located between a first wall and a second wall of the three inflatable walls, and able to receive a first beam; and wherein a second recess is located between the first wall and a third wall of the three inflatable walls, and able to receive a second beam, wherein the second recess is substantially perpendicular to the first recess.

* * * * *